United States Patent [19]

Young et al.

[11] 4,010,506

[45] Mar. 8, 1977

[54] OSCILLATING TOOTHBRUSH

[76] Inventors: Stuart Jay Young, 310 Lexington Ave., New York, N.Y. 10016; Isaac Berger, 159 W. 58th St., New York, N.Y. 10019

[22] Filed: Sept. 25, 1975

[21] Appl. No.: 616,566

[52] U.S. Cl. ..... 15/22 R
[51] Int. Cl.[2] ..... A46B 13/08
[58] Field of Search ..... 15/22 R, 22 C, 26

[56] References Cited

UNITED STATES PATENTS

| | | | |
|---|---|---|---|
| 1,835,837 | 12/1931 | Alles | 15/22 R |
| 3,261,047 | 7/1966 | Klang | 15/22 R |
| 3,408,671 | 11/1968 | Klang | 15/22 R |
| 3,585,669 | 6/1971 | Moret et al. | 15/22 R |

FOREIGN PATENTS OR APPLICATIONS

| | | | |
|---|---|---|---|
| 1,805,982 | 10/1968 | Germany | 15/22 R |

*Primary Examiner*—Edward L. Roberts
*Attorney, Agent, or Firm*—Harry Ernest Rubens

[57] ABSTRACT

An oscillating toothbrush is disclosed in which an offset brushing head is integrally attached to a shank, the shank being housed with a two piece cylindrical handle. A pair of opposite pin surfaces cooperate with internally enclosed helical slots to provide an oscillating up down movement as the toothbrush moves across the surface of the teeth. The handle is provided with a rear stop surface cooperating with the end of the shank at which there is also located an apparatus of smaller diameter than the end of the shank in order to permit cleaning of the insides of the oscillating toothbrush.

2 Claims, 4 Drawing Figures

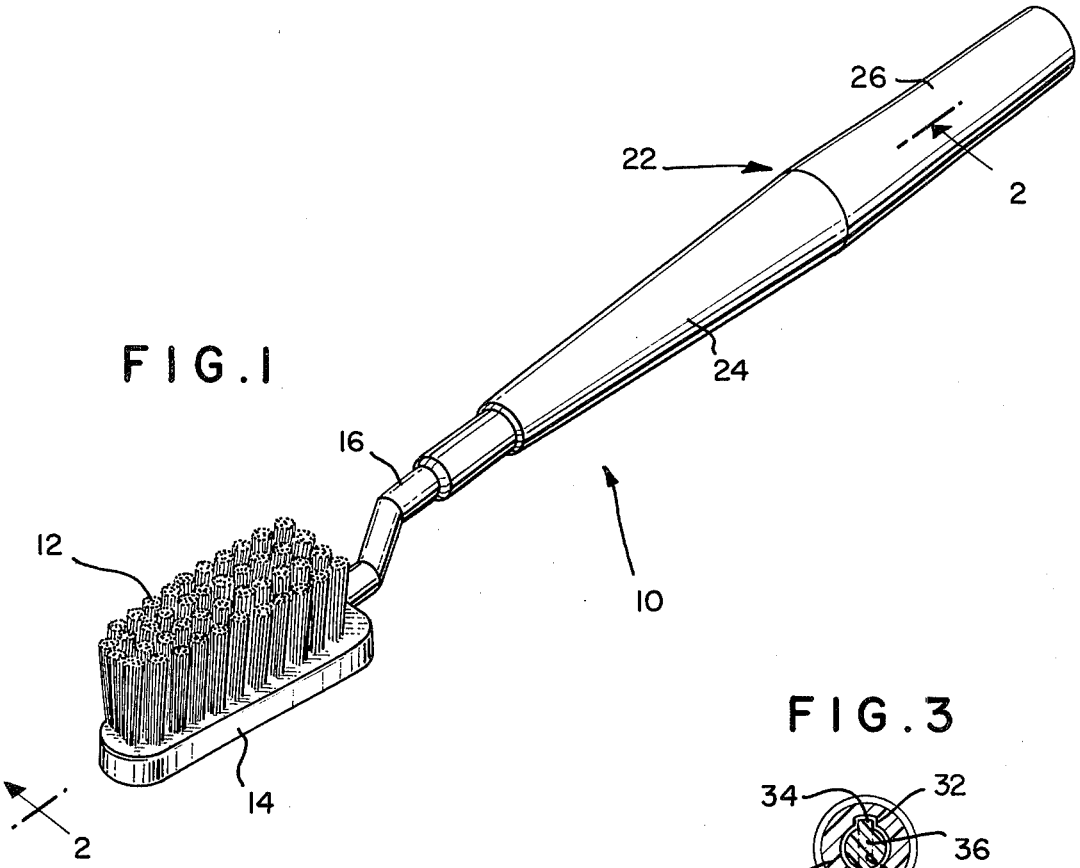
FIG. 1
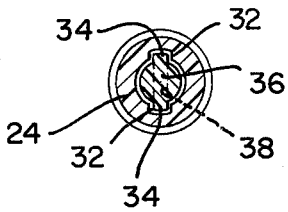
FIG. 3
FIG. 2
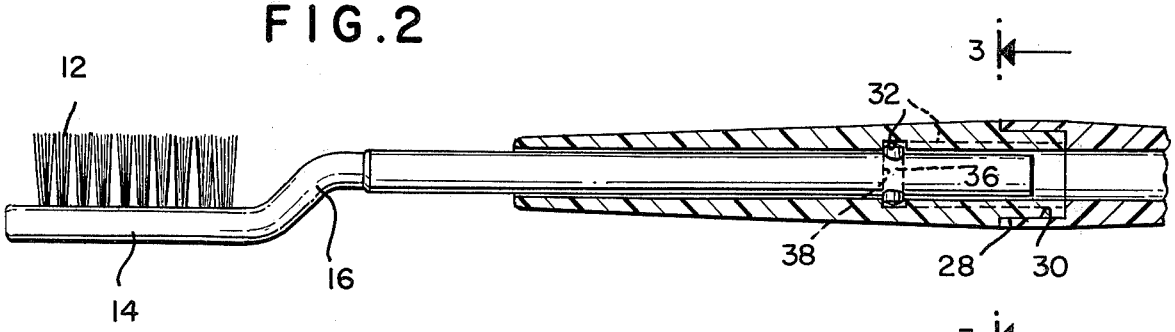
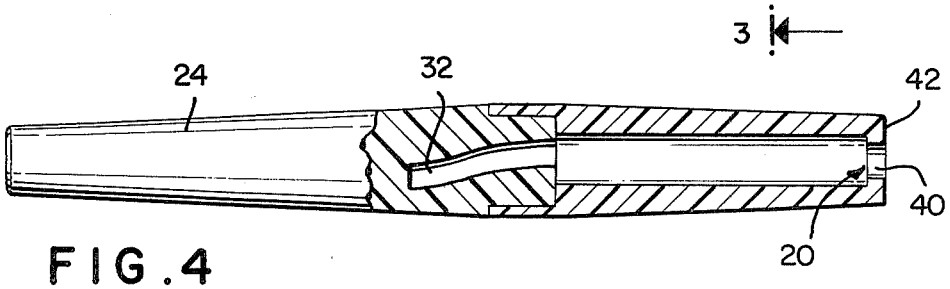
FIG. 4

OSCILLATING TOOTHBRUSH

BACKGROUND OF THE INVENTION

This invention relates to a an oscillating toothbrush, and more particularly to a toothbrush which has its brushing surface move upwardly and downwardly as the brush moves across the surface of the teeth.

There has been provided a relatively simple construction for an oscillating toothbrush illustrated in U.S. Pat. No. 3,261,047 issued to W. Klang, entitled "Toothbrush" on July 19, 1966. This toothbrush discloses a cylindrical handle partially enclosing a shank to which there is attached opposite pins, the opposing pins cooperating with through helical slots in the body of the handle of the toothbrush. The brushing end of the shank is offset from the main shank portion and as the toothbrush moves across the teeth, the brushing surface acquires an up down brushing motion.

There is also disclosed an oscillating toothbrush of a more complex construction issued to S. Yusko, U.S. Pat. No. 2,660,745 entitled "Oscillating Toothbrush" issued on Dec. 1, 1953 in which a complex helical spring arrangement is provided and cooperation with a pin and helical slot construction. In this oscillating toothbrush, the brushing surface is not offset from the shank portion and the shank portion is entirely enclosed within the body of a handle held while the toothbrush is moved across the surface of the teeth.

The above mentioned Klang patent has the disadvantage that the open through slot provided for achieving the up and down motion of the brushing surface has the particular properties of picking up debris such as hair and the like which would cause the cooperating pin and slot members to become dirty, interfering with its proper operation. Further, the stop surface for the back and forth motion of the shank portion of the oscillating toothbrush of the Klank construction is the pin cooperating with the helical slots. Since the pin is of a relatively light construction, the forces imparted to the pin as it stops in both the front and rear portions, especially the rear portion can be excessive causing the pins to easily crack and break from the shank. In addition, the Klang construction has the distal end of the shank extending beyond the rear of the handle thus providing an unattractive appearance and further providing the dangerous possibility that the distal end as it moves in and out of the handle can cause injury to the user.

The prior Yusko construction generally is of a complex nature which is improved upon by the Klang construction and also does not effectively achieve the brushing operation. Further, the manner in which the Yusko brush can be assembled and the stop surfaces provided as well as effective cleaning action can all present significant problems in the Yusko construction.

An object of this invention is to provide an improved oscillating toothbrush in which the appearance is attractive, the cost of construction is low, and the operation is trouble free.

Another object of this invention is to provide such an oscillating toothbrush which can be effectively cleaned.

Yet another object of this invention is to provide such an oscillating toothbrush which can be easily assembled and also disassembled for cleaning of the various members of the toothbrush.

Still another object of this invention is to provide such as oscillating toothbrush in which the cooperating helical slot and pin member is achieving the oscillating motion or protected from foreign matter so as to prevent an unimpaired cooperating set of surfaces for achieving the oscillating function.

Yet another object of this invention is to provide such an oscillating toothbrush in which the pin member is prevented from shearing during its operation because of the force imparted to it as it approaches its rear stop position.

Other objects, advantages and features of this invention will become more apparent from the following description.

SUMMARY OF THE INVENTION

In accordance with the principles of this invention, the above objects are accomplished by providing for an oscillating toothbrush which comprises a brush head, a shank integrally connected to the head with the brush head being offset from the shank, a pair of oppositely projecting pin surfaces extending from the shank and adapted to move in cooperating helical slots, the invention comprising providing a cylindrical handle member substantially enclosing the shank with the rear end of the shank forming a cooperating stop surface with a substantially enclosed end of the handle. The substantially enclosed end of the handle also has a small aperature allowing for water to run therethrough so as to clean the inner portions of the cooperating surfaces of the oscillating toothbrush.

As a feature of this invention, the helical slots are entirely enclosed within the handle so as to prevent foreign matter from clogging and interferring with the helical slot and pin motion.

The handle is formed of two cooperating cylindrical members having tapered mating surfaces, the mating surfaces forming a friction fit so as to enable the handle to be easily assembled. In operation, the pin surfaces are formed of a pin fitted through a through hole in the shank, the shank and pin being assembled and inserted in one of the two cooperating cylindrical members forming the handle. The second member is then placed over the rear end of the shank and closing the shank, pin surfaces and helical slots allowing for efficient operation thereof.

BRIEF DESCRIPTION OF THE DRAWINGS

FIG. 1 is a perspective view of the assembled toothbrush of this invention;

FIG. 2 is a perspective view along lines 2—2 of FIG. 1;

FIG. 3 is a perspective view along lines 3—3 of FIG. 2; and

FIG. 4 is a partial sectional view of the rear end of one of the cooperating members of the cylindrical handle and the inner enclosed shank member therein.

DETAILED DESCRIPTION

With reference to figures and in particular to FIG. 1, there is generally shown the oscillating toothbrush 10 having a forward brushing surface 12 attached to a seating surface 14 in which the bristles of the brushing member 12 are seated. The seating surface 14 is integrally connected to a shank 16 and is offset therefrom as illustrated in FIGS. 1 and 2, the shank extending and terminating in a distal end 20. The shank is enclosed within a handle 22 formed of two cooperating members 24 and 26, the members 24 and 26 having cooperating tapered surfaces 28 and 30 respectively (see FIG. 2) so as to achieve a desired friction fit when the toothbrush handle is assembled.

Referring to FIGS. 2, 3 and 4, there is shown an enclosed helical slot 32 formed by a recess within the handle 22, the helical slot extending along the handle and forming a cooperating surface with projecting pin surfaces 34 (see FIG. 3), the pin surfaces being formed of a pin 36 adapted to fit through a through hole 38 in the shank. As the toothbrush is moved laterally across the surface of the teeth, the camming action formed by the pin surfaces 34 in slot 32 causes the brushing surface 12 to achieve an up down motion for effectively cleaning the teeth.

In accordance with a feature of this invention, the handle has at its distal end, an aperture 40 which is somewhat smaller than the distal end 20 of the shank such that the distal end 20 and circular surface 42 around the aperature 40 form a stop as the oscillating toothbrush moves back and forth. As described above, this stop substantially eliminates the force imparted to the pin in the Klang patent to which frequently caused the pin to crack or break. Further, there is illustrated the aperture 40 which enables water to be flushed therethrough so as to clean the innards of the toothbrush.

Providing the slot 32 within the handle prevents the slot from picking up debris and other matter which interferes with the proper operation of the above described Klang toothbrush.

With reference to FIGS. 1 and 2, there is shown the handle being formed of two cylindrical members, the two cylindrical members enabling the toothbrush to be easily assembled. Thus, the toothbrush is assembled by placing the pin 36 through the through hole 38 and placing the assembled pin and shank within member 24. After that is completed, cooperating cylindrical piece 26 is frictionally fit onto cylindrical piece 24 so as to enclose the shank forming the handle portion of the toothbrush.

There has thus been described an improvement over prior existing oscillating toothbrushes, and the embodiment illustrated above is merely to suggest the improvement by way of a specific illustration as to the major of this invention, the embodiment merely illustrating the principals of the invention with the claims attached hereto defining the scope of protection sought for this invention.

We claim:

1. An oscillating toothbrush comprising a brush head, a shank integrally connected to said brush head with said brush head being offset from said shank, a pair of oppositely projecting removable pin surfaces extending from said shank and adaptable to move in and out of cooperating helical slots, a cylindrical handle member substantially enclosing said shank, one end of said cylindrical handle terminating in a removable circular stop surface with an aperture formed at the center thereof, said circular stop preventing the pin surfaces from moving out of said slots, the end of said shank at said one end of said cylindrical handle forming a cooperating stop surface larger than said aperture and adapted to abut against said circular stop surface, whereby during assembly the shank may be inserted into the cylindrical handle member and the pair of pin surfaces inserted into the shank, the shank pins inserted into the helical slots and the removable stop surface secured to the cylindrical handle member to allow the pins to be moved only within the slots.

2. The invention of claim 1, wherein said cylindrical handle is formed of two cylindrical members having mating surfaces, said slots being formed by helical depressions in opposite inside walls of one of said two cylindrical members, such that said helical slots are completely enclosed with said cylindrical handle.

* * * * *